United States Patent [19]

Repka

[11] 4,139,133

[45] Feb. 13, 1979

[54] MONEY BELT

[76] Inventor: Raymond R. Repka, S. #7 Carefree La., Cheektowaga, N.Y. 14227

[21] Appl. No.: 814,179

[22] Filed: Jul. 11, 1977

[51] Int. Cl.[2] ..... A45C 1/04

[52] U.S. Cl. ..... 224/26 C; 2/DIG. 6; 224/5 R

[58] Field of Search ..... 224/5 R, 5 L, 26 R, 224/26 C, 26 D, 26 F, 26 H, 26 K, 28 R, 128 B; 24/3 R, 3 A, 3 F, 204; 2/DIG. 6, 247, 248, 249

[56] References Cited

U.S. PATENT DOCUMENTS

| | | | |
|---|---|---|---|
| 842,037 | 1/1907 | Wallerstedt | 224/26 D |
| 1,792,862 | 2/1931 | Oyler | 224/26 R X |
| 2,392,533 | 1/1946 | Issac | 224/26 R X |
| 2,442,621 | 6/1948 | Silverstein | 224/26 D |
| 2,615,754 | 10/1952 | Lindenberg | 24/3 F X |
| 3,129,862 | 4/1964 | Cone | 224/5 R |
| 3,542,263 | 11/1970 | Callahan | 224/26 D |
| 3,664,560 | 5/1972 | Perkins | 224/26 R X |
| 4,022,361 | 5/1977 | Devlin | 224/26 R X |

*Primary Examiner*—Trygve M. Blix
*Assistant Examiner*—Winston H. Douglas
*Attorney, Agent, or Firm*—Christel & Bean

[57] ABSTRACT

A detachable pocket or enclosure especially adapted for use with wearing apparel such as a belt and comprising three panel members which may be folded into juxtaposed position with respect to one another so as to enclose money or the like in a safeguarded manner. The enclosure, in a fully folded condition, mounts on the inner surface of a user's belt by means of replaceable adhesive tabs whereby the enclosure may be utilized with any number of different belts. The adhesive fastening tabs extend through aligned apertures in the panel portion of the enclosure adjacent the belt's surface so as to be reversibly affixed to an interior panel surface of the enclosure. In this manner, the enclosure is both maintained in a closed disposition as well as retained in place against the belt's surface. The reversible attachment of the adhesive fastening means to an inner panel of the enclosure is provided, for example, by the utilization of Velcro material.

2 Claims, 4 Drawing Figures

MONEY BELT

BACKGROUND OF THE INVENTION

This invention relates generally to wearing apparel and more particularly to the construction of a detachable money enclosure to be used in conjunction with a user's belt.

The prior art includes numerous types of money belts of various designs, all of which have respective design features applicable to the specific purposes for which such money belts are utilized. Generally, such prior art money belts include pockets integrally formed in the belt which are accessible through the surface of the belt adjacent a user's waist. Such pocket may, for example, be closed and opened by use of zippers and similar types of closure elements.

A significant drawback to this type of prior art structure resides in the fact that such a composite belt structure is considerably more expensive than a comparable ordinary belt without money pockets associated therewith. In addition, a user in coordinating his wearing apparel from an aesthetic point of view is unduly limited by any one given money belt and accordingly must own a plurality of such belts.

SUMMARY OF THE INVENTION

A general object of the present invention is to provide a money pocket enclosure which may be utilized interchangeably with any number of ordinary belts.

Another object of the present invention is to provide a money pocket enclosure which effectively precludes potential loss of money or similar valuables contained therein during use.

Yet another object of the present invention is to provide a detachable enclosure for use with wearing apparel in general wherein the adhesive fastening means associated therewith for affixing the enclosure to the wearing apparel may be easily replaced as the effectiveness of the adhesive material diminishes.

A still further object of the present invention is to provide a money pocket enclosure which may be easily opened and closed so as to enable a user thereof to make effective use of the same.

In summary, the present invention provides a money pocket enclosure having three flaps or panel like members. A base panel member, having spaced side edges, includes a mounting panel attached along one of the side edges and a locking flap or panel attached along the other of its side edges. The locking flap may be folded into juxtaposed position with respect to the base panel whereby the locking flap and base panel may be folded into juxtaposed position with respect to the mounting panel with the locking flap being disposed between the mounting and base panels. Adhesive fastening means extend through corresponding openings in the mounting panel to engage the adjacent surface of a belt or adjacent surface of a piece of wearing apparel. The adhesive fastening means are in turn affixed to the surface of the locking flap adjacent the mounting panel when the enclosure is fully folded as, for example, by means of a Velcro material. By this arrangement the adhesive fastening means may be easily replaced as they wear out. When in place, the adhesive fastening means retain the locking flap in juxtaposed position with respect to the mounting panel and in turn retain the entire enclosure in place against the surface of a piece of wearing apparel. In this manner, money or other similar material may be securely retained between the folded locking flap and the base panel. The enclosure can be of any selected length, having any number of apertures and adhesive fastening means. If deemed necessary, the ends of the panel members, and in particular the locking flap and base panel, could be sealed together so as to preclude any possibility of enclosure contents passing outwardly through the ends thereof.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

DETAILED DESCRIPTION OF A PREFERRED EMBODIMENT

Figure 1:
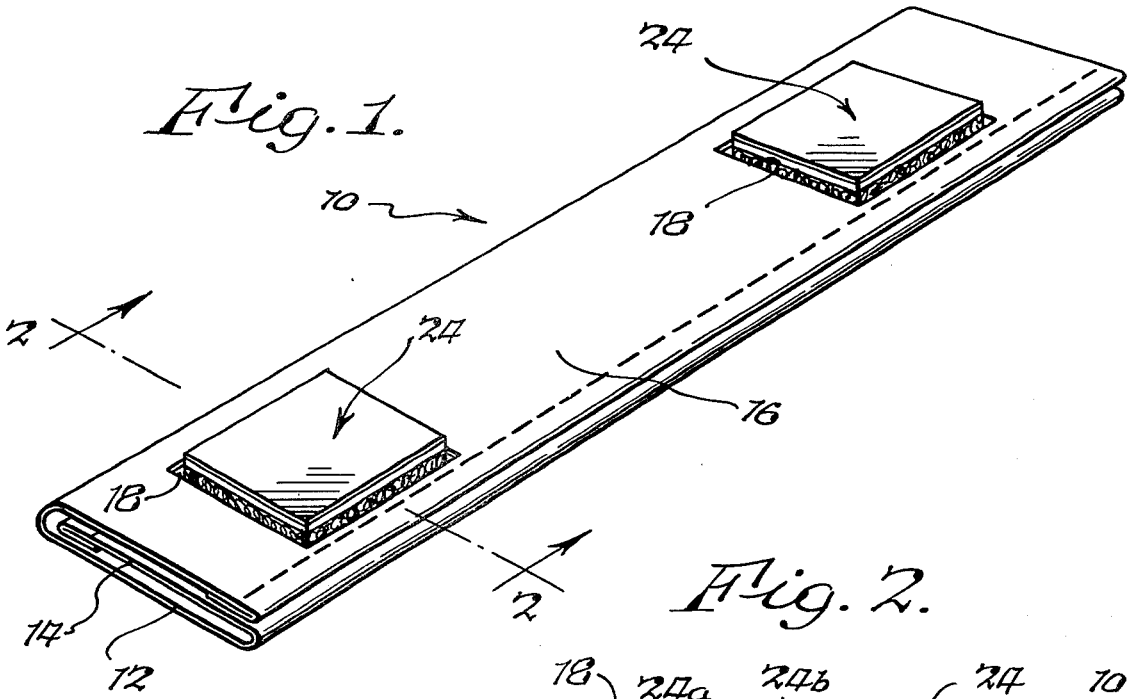
FIG. 1 is a perspective view of a detachable enclosure constituting the present invention illustrated in a fully closed disposition.
Figure 2:
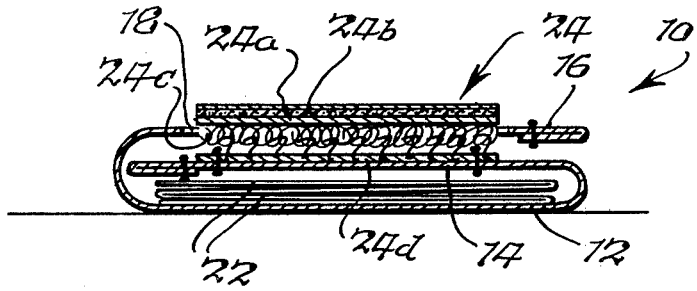
FIG. 2 is a transverse view in section taken about on line 2—2 of FIG. 1.
Figure 3:
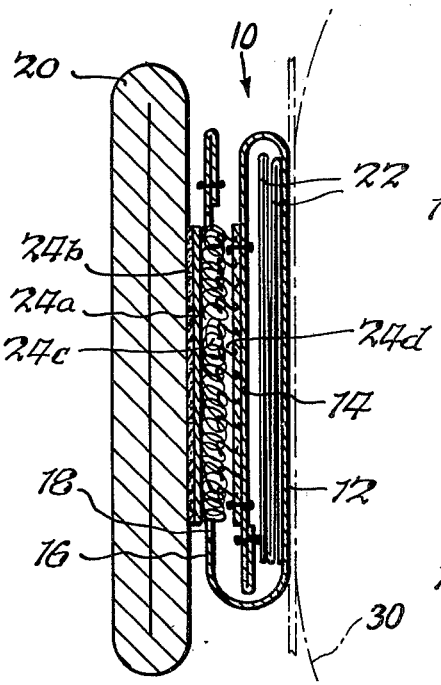
FIG. 3 is a view similar to FIG. 2, showing the enclosure in a vertical disposition mounted against the inner surface of a piece of wearing apparel, such as a belt for example.
Figure 4:
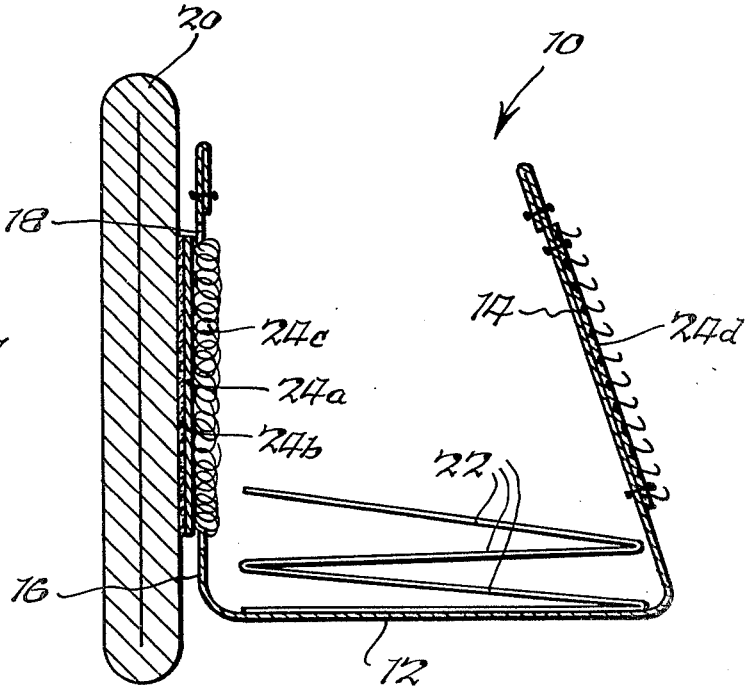
FIG. 4 is a view similar to FIG. 3, showing the enclosure with the locking flap and a base panel thereof in an opened disposition.

Referring now in detail to the illustrative embodiment depicted in the accompanying drawings, there is shown in FIG. 1 an enclosure (10) constituting an embodiment of the present invention. As viewed in conjunction with FIG. 2, the enclosure includes a base panel (12), a locking flap (14) and a mounting panel (16). The panels (12) and (16) and locking flap (14) are of indeterminate length whereby the enclosure may be selectively sized to accommodate any number of specific uses. Mounting panel (16) includes mounting apertures (18) through which a fastening arrangement protrudes to retain enclosure (10) in fixed position against a piece of wearing apparel such as (20) and furthermore to retain the enclosure in an affirmatively locked disposition. In this regard, it is to be understood that the locking flap (14) attached along one of the side edges of the base panel (12) may be folded into a juxtaposed position with respect to the base panel, as illustrated in the two views of FIGS. 3 and 4. The locking flap is thereby disposed intermediate to the base panel and the mounting panel (16) when the base panel (12) is also folded into juxtaposed position with respect to the mounting panel (16). In this latter condition, money or paper bills (22) and the like may be securely maintained within the cavity defined by locking flap (14), base panel (12) and the juncture between base panel (12) and mounting panel (16).

Composite fastening means arrangements generally indicated at (24) in FIG. 1 extend through the apertures (18) in mounting panel (16). Each fastening arrangement (24) comprises a base layer of material (24*a*) on the upper side of which is provided an adhesive coating (24*b*). The other side of the base (24*a*) includes or has mounted thereon a woolly material (24*c*). In addition, a hooked fabric (24*d*) is provided on the surface of the locking flap (14) which is adjacent to the woolly material (24*c*) when the locking flap is folded into juxtaposed position with respect to the base panel (12) and mounting panel (16) whereby the hooked fabric (24*d*) becomes enmeshed in the woolly material (24*c*). The co-acting materials (24*c*) and (24*d*) are commonly known as Velcro material, for example.

In using the detachable enclosure of the present invention, it can be easily affixed to the inner surface of any belt (20) for example, or any other appropriate piece of wearing apparel by pressing the adhesive material (24*b*) against the surface of the wearing apparel whereby the adhesive assumes a fixed position thereon. The belt is thus secured between the wearer 30 and the piece of apparel 20. In order to gain access to the interior of the enclosure the locking flap (14) is pulled away from the mounting panel (16) by urging the hooked fabric (24*d*) to disengage from the woolly material (24*c*). Upon continued unfolding of the locking flap (14) as viewed in FIG. 4, ready access is had to the pocket defined in part by the base panel (12) and locking flap (14), again as viewed in FIG. 4. Upon the removal or deposit of money from or to the area between the panel (12) and locking flap (14), the locking flap (14) may be folded into juxtaposed position upon panel (12) with both of these elements folded into juxtaposed position with respect to mounting panel (16) to be held in fixed position thereto by the engagement of the hooked fabric (24*d*) with the woolly material (24*c*).

Necessarily, the entire enclosure can be removed from a piece of wearing apparel by simply separating the adhesive layers (24*b*) therefrom. After extended use, the adhesive material (24*b*) may become ineffective in terms of firmly engaging the inner surface of a belt, for example. However, it has been anticipated that the portion of the fastening means (24) comprising the base layer (24*a*) and adhesive layer (24*b*) and woolly material (24*c*) may be replaced as the adhesive layer (24*b*) wears out. Necessarily, the disposition of the hooked material or fabric (24*d*) and woolly material (24*c*) could be reversed with respect to the locking flap (14) and mounting panel (16) without affecting the operation of the enclosure as described hereinabove. Furthermore, it is within the scope of this invention that separate fastening means could be provided to be operable between the locking flap (14) and the mounting panel (16) so as to retain the locking flap and base panel (12) in a fully folded juxtaposed position with respect to the mounting panel (16). In this regard, second, separate fastening means such as interchangeable adhesive tabs could be provided to mount the enclosure on a piece of wearing apparel by disposition of such adhesive tabs or any other suitable tab or equivalent fastening means between the mounting panel (16) and a piece of wearing apparel.

From the foregoing, it is apparent that the objects of the present invention have been fully accomplished. As a result of this invention, an improved enclosure for retaining money and the like on a piece of wearing apparel is provided whereby the same may be utilized in conjunction with any number of pieces of wearing apparel.

Having thus described and illustrated the preferred embodiment of my invention, it will be understood that such description and illustration is by way of example only and that such modifications and changes as may suggest themselves to those skilled in the art are intended to fall within the scope of the present invention as limited only by the appended claims.

I claim:

1. A detachable enclosure, for receiving money and the like, adapted to be used in combination with an article of wearing apparel, said enclosure comprising a base panel having a pair of spaced side edges, a mounting panel, said mounting panel being attached along one of said side edges of said base panel whereby said base panel may be folded into juxtaposed position with respect to said mounting panel, said mounting panel comprising a plurality of apertures therein, a locking flap attached along the other of said side edges of said base panel whereby said locking flap may be folded into juxtaposed position with respect to said base panel so as to be disposed intermediate to said base panel and said mounting panel when said base panel is folded into juxtaposed position with respect to said mounting panel so that money and the like may be enclosed between said locking flap and said base panel, first fastening means operably disposed between said mounting panel and said locking flap for retaining one to the other, said first fastening means comprising a hooked fabric or wooly material, second fastening means operably associated with said mounting panel for retaining said mounting panel on an article of wearing apparel, said second fastening means including adhesive means on one side thereof for affixation of said second fastening means to an article of wearing apparel and on the opposite side thereof a hooked fabric when said first fastening means comprises a woolly material and a woolly material when said first fastening means comprises a hooked fabric, said second fastening means being arranged within said apertures to cooperatively engage said first fastening means so as to maintain said enclosure in folded position.

2. A detachable enclosure, as set forth in claim 1, in combination with a user's belt wherein said enclosure is disposed between a user's waist and the adjacent surface of said belt by engagement of said adhesive material on said second fastening means against the surface of said belt adjacent the user's waist.

* * * * *